United States Patent [19]

Schneider

[11] 3,984,091

[45] Oct. 5, 1976

[54] PISTON RING ARRANGEMENT FOR A TAPHOLE GUN

[75] Inventor: Werner Schneider, Siegen, Westphalia, Germany

[73] Assignee: Dango & Dienenthal KG, Siegen, Westphalia, Germany

[22] Filed: Jan. 14, 1975

[21] Appl. No.: 541,064

[30] Foreign Application Priority Data

Jan. 17, 1974 Germany ..... 2402088

[52] U.S. Cl. ..... 266/273

[51] Int. Cl.[2] ..... C21B 7/12

[58] Field of Search ..... 266/42, 271–273

[56] References Cited

UNITED STATES PATENTS

| | | | |
|---|---|---|---|
| 1,332,298 | 3/1920 | Kennedy | 266/42 |
| 1,767,660 | 6/1930 | Fraser | 266/42 |
| 1,852,560 | 4/1932 | Giese | 266/42 |

*Primary Examiner*—Roy Lake
*Assistant Examiner*—Paul A. Bell
*Attorney, Agent, or Firm*—Toren, McGeady and Stanger

[57] ABSTRACT

In a taphole gun for use in closing tapholes in blast furnaces and the like, a tamping piston is axially displaceable through a cylinder for forcing tamping material into the taphole. An annular recess is formed in the circumferential periphery of the tamping piston and a piston ring is fitted into the annular recess. The piston ring is dimensioned relative to the recess so that tamping material enters the recess and exerts pressure on the piston ring forcing it radially outwardly against the inner surface of the cylinder and axially against the tamping piston.

11 Claims, 6 Drawing Figures

PISTON RING ARRANGEMENT FOR A TAPHOLE GUN

SUMMARY OF THE INVENTION

The present invention is directed to a taphole gun and, more particularly, it concerns the arrangement of a pistoning within a recess in the circumferential periphery of an axially displaceable tamping piston within the cylinder of the taphole gun.

Taphole guns are known for closing tapholes, in particular, in blast furnaces, low-shaft furnaces and also Siemens-Martin furnaces in which the tamping material is forced from a cylinder in the gun into the taphole. As a rule, the front end of the cylinder is conically tapered for reducing the diameter of the cylinder down to the diameter of the taphole. Because of the tapered configuration, a relatively high pressure is required on the tamping piston, since the tamping material has a high resistance to deformation and a low plasticity. Moreover, the counterpressure of the metal issuing at the bottom under the internal pressure of the furnace and a high resistance in the washed-out taphole must be overcome.

In known embodiments, a gap of several tenths of a millimeter is provided between the tamping piston and the cylinder wall to prevent seizing of the oppositely moving parts by the tapping components in the tamping material. However, it is unavoidable that the tamping piston and the cylinder wall will be increasingly damaged and worn out, even after a short operating period due to the lapping action of the components of the tamping material and, as a result, costly repairs are required. The wear of the cylinder wall can be reduced by inserting a tempered bushing, but this is an extremely expensive alternative.

Another problem in known taphole guns is that the tamping material passing through the gap between the cylinder wall and the tamping piston accumulates in the rear portion of the cylinder when the tamping piston is moved rearwardly. If quick-hardening tamping materials are used, as has become customary in recent years in blast furnace operations, the hardened materials cannot be removed even after a short period of time, through the opening provided for such removal in the cylinder wall. Accordingly, it is no longer possible to return the piston into its rearward position and the capacity of the cylinder is continuously being diminished.

Sealing the piston with known piston rings has the disadvantage that the piston rings cake on the piston, due to the tamping material and the relatively low radial tension force of the piston rings becomes ineffective. After a short operating period the piston rings tend to break with a resultant temporary stoppage in the use of the equipment.

The present invention is directed to providing a taphole gun with a tamping piston which is sealed from the cylinder wall by one or several piston rings; however, the use of these rings does not involve any of the disadvantages set forth above and is characterized by a minimum of wear and by being very economical, especially with regard to the operating time of the cylinder. Furthermore, it is possible for the tamping piston to work satisfactorily even when different tamping materials are used.

In accordance with the present invention, a piston ring with a relatively large cross section is arranged in an annular groove formed in the circumferential periphery of the tamping piston with the end face of the piston ring facing in the direction in which the tamping material is forced, being in contact with the tamping material. As a result, the pressure exerted within the tamping material acts directly on the piston ring. Due to the large cross section of the ring, it has a correspondingly high tension force which ensures a tight bearing of the ring against the inner wall of the cylinder. Preferably, the face or surface of the piston ring opposite the surface contacted by the tamping material has a frustoconically shaped configuration and bears in a sliding manner on a counter-surface of the annular groove. The counter-surface of the groove can be similarly frustoconically shaped or it may have a lens or a convex shape in the radial direction.

Therefore, in accordance with the invention, the piston ring has the particular advantage that it bears tightly against the cylinder wall under low pressure, due to its own initial stress, and it is spread at higher pressures under the action of the tamping material and the arrangement of its frustoconical surface so that an additional pressing action against the cylinder wall is provided.

As a result, the pressure exerted within the tamping material acts directly on the piston ring. Due to the large cross section of the ring, it has a correspondingly high tension force which ensures a tight bearing of the ring against the inner wall of the cylinder. Preferably, the face or surface of the piston ring opposite the surface contacted by the tamping material has a frustoconically shaped configuration and bears in a sliding manner on a counter-surface of the annular groove. The counter-surface of the groove can be similarly frustoconical in shape or it may have a lens or convex shape in the radial direction.

Therefore, in accordance with the invention, the piston ring has the particular advantage that it bears tightly against the cylinder wall under low pressure, due to its own initial stress, and it is spread at higher pressures under the action of the tamping material and the arrangement of its frustoconical surface so that an additional pressing action against the cylinder wall is provided.

If the counter-surface on the tamping piston is convex or lens shaped, piston rings with different slopes on their frustoconical surfaces can be used in order to generate different radial forces at the same pressure. With this characteristic it is possible to ensure a radial force corresponding to the particular type tamping material being used.

An alternative arrangement involves the use of a counter-ring a frustoconically shaped surface and mounted in a stationary position within an annular groove in the tamping piston. The annular groove may, for example, have a U-shaped cross section. The counter-ring is arranged so that its frustoconical surface bears against the complementary frustoconical face of the piston ring. In this alternative arrangement, two rings are always used.

To permit easy insertion or replacement of the piston ring and of a complementary counter-ring, if one is used, a cover disc is mounted on the circumferential peripheral edge of the tamping piston at at its end facing in the direction in which the tamping material is displaced. The cover disc has an outside diameter smaller than the inside diameter of the cylinder so that a circumferential gap is provided between these two.

Further, the juxtaposed surfaces of the piston ring and the cover disc are spaced apart. As a result, as the tamping piston is displaced forwardly, the tamping material passes through the circumferential gap between the cover disc and the cylinder into the space rearwardly of the cover disc for contacting the surface of the piston ring. Thus, the tamping material affords a pressing action against the piston ring. Due to the radial dimension of the surface of the piston ring facing the cover disc a relatively large area is exposed to the pressing action of the tamping material and a considerable pressing force is assured.

Another distinquishing feature of the piston ring is the formation of its inside diameter considerably greater than the corresponding diameter of the juxtaposed surface on the tamping piston so that an annular space is provided between the inwardly directed surface of the piston ring and the juxtaposed outwardly facing surface of the tamping piston. When the tamping material is compressed by the piston it not only enters the radially extending space between the cover disc and the piston ring but it also enters the annular space between the inside surface of the piston ring and the oppositely directed surface of the tamping piston and provides an additional sealing force on the piston ring acting in the radial direction.

To prevent damage to the piston even in the case where only a small amount of tamping material can pass between the cylinder wall and the piston ring, the surface of the piston is spaced inwardly from the cylinder wall in accordance with the invention. Further, to provide an adequate seal against the passage of tamping material, where the piston ring is split, a sliding member is positioned across the split or opening in the piston ring to assure a seal against the pressure of the tamping material through the opening.

The various features of novelty which characterize the invention are pointed out with particularity in the claims annexed to and forming a part of this specification. For a better understanding of the invention, its operating advantages and specific objects attained by its use, reference should be had to the accompanying drawing and descriptive matter in which preferred embodiments of the invention are illustrated and described.

BRIEF DESCRIPTION OF THE DRAWING

Figures 1, 2, 3, 3A, 4, 5:
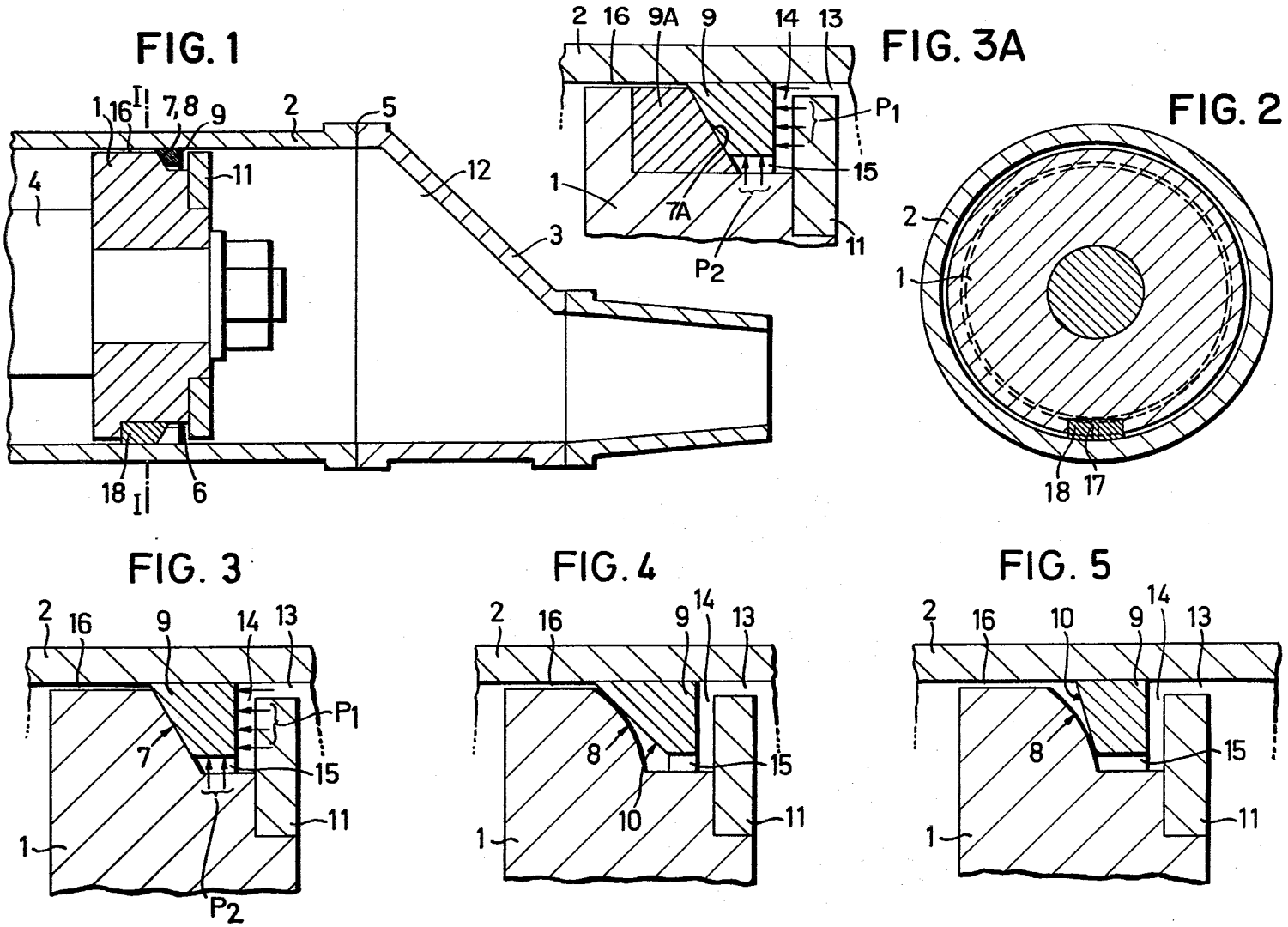

IN THE DRAWING:

FIG. 1 is an axially extending section through a cylinder and a tamping piston in a taphole gun which embodies the present invention;

FIG. 2 is a transverse sectional view taken along the line I—I in FIG. 1;

FIG. 3 is an enlarged representation of the piston ring illustrated in FIG. 1;

FIG. 3A is a view similar to FIG. 3 showing the piston ring and a complementary counter-ring; and FIGS. 4 and 5 illustrate alternative arrangements of the annular groove and piston ring shown in FIG. 3.

DETAILED DESCRIPTION OF THE INVENTION

In FIG. 1 a portion of a taphole gun is illustrated including a tamping piston 1 mounted for axial displacement within a cylinder 2 which contains the tamping material. Cylinder 2 has a first or forward end provided with a conical taper 3 which is introduced into a taphole, not shown, in a blast furnace or the like and which can be removed at the junction 5. The second or rearward end of the cylinder is not shown, but as viewed in FIG. 1; it would be to the left of the tamping piston 1. The tamping piston is moved axially within the cylinder by means of a piston rod 4. The tamping piston has a first end facing in the direction of the conical taper 3 and a second end to which the piston rod 4 is attached. An annular groove or recess 6 is formed on the circumferential periphery of the tamping piston 1 adjacent the first end of the piston. As shown in FIG. 1, the surface 7 of the recess 6 which extends radially outwardly and is closer the second end of the tamping piston, is frustoconically shaped. The frustoconical shape can be more clearly seen in FIG. 3. Further, the surface 7 in FIG. 1 is also designated by the reference 8 which represents, as shown in FIGS. 4 and 5, a surface which is convex or lens shaped viewed in radial section. Positioned within the recess 6 is a piston ring 9 having a frustoconically shaped rearwardly facing surface 10 which is disposed in contacting relationship with the surface 7, 8 of the annular recess 6. The surface 7, 8 acts as a counter-surface against which the surface 10 of the piston ring is pressed. The surface 10 can be arranged to slope at different angles to the axis of the cylinder, as is shown.

At the first end of the tamping piston 1, an annular cover disc 11 seated in the circumferential periphery of the piston, forms or defines the surface of the recess 6 opposite the surface 7, 8. The cover disc 11 partially seals the recess 6 from the interior 12 of the cylinder in front of the first end of the piston. As can be seen in Fig. 1, the radially outer surface of the cover disc 11 is spaced inwardly from the inner surface of the cylinder 2 so that an annular slot 13 is provided between these two. Furthermore, the piston ring has an axial dimension such that it is spaced within the recess 6 from the rearwardly facing surface of the cover disc 11. As a result, an interval or space 14 extends from the base of the recess 6 to the inner surface of the cylinder 2. Further, the inside diameter of the piston ring 9 is greater than the diameter of the base of the recess 6 so that a space 15, note FIGS. 3, 4 and 5, is provided therebetween. The space 15 is in direct communication with the radially inner end of the space 14. A narrow clearance 16 of several millimeters is provided between the inside wall of the cylinder 2 and the circumferential periphery of the tamping piston 1 rearwardly of the recess 6. As can be seen in FIG. 2, the piston ring 9 is a split ring with a narrow opening 17 provided between the juxtaposed ends of the ring. As shown in FIGS. 1 and 2, a sliding member 18 is provided within a recess in the tamping piston so that it forms a cover over the opening 17. The surface of the sliding member 18 which contacts the frustoconically shaped surface 10 of the piston ring is provided with a complementary sloping surface.

When the tamping piston is displaced axially against the tamping material within the space 12 in the cylinder 2, the pressure acting on the tamping material forces some of it through the annular space 13 between the radially outer surface of the cover disc 11 and the inner wall of the cylinder 2 into the radially extending space 14 between the cover disc and the piston ring 9 where the material is forced inwardly into the annular space 15 located radially inwardly of the inner surface of the piston ring. As a result, the force or pressure developed in the tamping material presses against the piston ring 9 as indicated by the pressures $P_1$ and $P_2$ in FIG. 3. The pressure $P_1$ acts in the axial direction of the tamping piston 1 and forces the piston ring so that its surface 10 is pressed against the surface 7 of the recess 6, note FIG. 3. The pressure $P_2$ presses the piston ring 9 radially outwardly and increases the pressure normally exerted by the piston ring against the inside surface of the cylinder 2. The movement of the piston ring under the pressure $P_1$ and $P_2$ is determined by the configuration of the counter-surface 7, 8 in the recess 6 in the tamping piston 1. In FIG. 3 the surface 7 is frustoconically shaped while in FIGS. 4 and 5 the surface 8 is convex or lens shaped in the radial direction and provides a variation in the reaction between the piston ring and the juxtaposed surface of the tamping piston.

In FIG. 3A a counter-ring 9A is mounted in a stationary position within the annular recess 6. The counter-ring 9A has a frustoconically shaped surface 7A replacing the surface 7 of the annular recess which is complementary to the frustoconical face of the piston ring.

While specific embodiments of the invention have been shown and described in detail to illustrate the application of the inventive principles, it will be understood that the invention may be embodied otherwise without departing from such principles.

What is claimed is:

1. A taphole gun comprising an axially extending cylinder arranged to hold tamping material said cylinder having a first end spaced axially from a second end, a tamping piston axially displaceable within said cylinder between the first and second ends for forcing tamping material from the first end of said cylinder, said tamping piston having a first end facing toward the first end of said cylinder a second end facing toward the second end of said cylinder and a circumferential peripheral surface extending between the first and second ends thereof, a piston ring encircling the circumferential peripheral surface of said tamping piston within said cylinder, wherein the improvement comprises that an annular recess is formed in the circumferential peripheral surface of said tamping piston facing toward the inner surface of said cylinder, said piston ring positioned and loosely fitting within said annular recess and spaced from the first and second ends of said tamping piston, the circumferential peripheral surface of said tamping piston between said annular recess and the first end of said tamping piston being spaced radially inwardly from the inner surface of said cylinder and forming a narrow annular space therebetween open to the space within said cylinder between the first end of said tamping piston and the first end of said cylinder, said piston ring being displaceable radially outwardly within said recess for surface contact with the inner surface of said cylinder, and when said tamping piston is displaced axially for forcing the tamping material from the first end of said cylinder a portion of the tamping material flows through said annular space into contact with said piston ring within said recess and displaces said piston ring radially outwardly into contact with the inner surface of said cylinder.

2. A taphole gun, as set forth in claim 1, wherein said annular recess extends from the first end of said tamping piston toward and spaced from said second end thereof, an annular cover disc positioned in the first end of said tamping piston on the radially outward periphery thereof defining a closure for the side of said annular recess in said tamping piston closer to the first end of said cylinder, and the radially outer surface of said cover disc being spaced inwardly from the inner surface of said cylinder and forming said narrow annular space for permitting the tamping material to pass between the inner surface of said cylinder and the radially outer surface of said cover disc into contact with the surface of said piston ring facing toward the first end of said cylinder.

3. A taphole gun comprising an axially extending cylinder arranged to hold tamping material, said cylinder having a first end spaced axially from a second end, a tamping piston axially displaceable within said cylinder between the first and second ends for forcing tamping material from the first end of said cylinder, said tamping piston having a first end facing toward the first end of said cylinder and a second end facing toward the second end of said cylinder, a piston ring encircling the circumferential periphery of said tamping piston within said cylinder, wherein the improvement comprises that an annular recess is formed in the circumferential periphery of said tamping piston facing toward the inner surface of said cylinder, said piston ring positioned within said annular recess and spaced from the first and second ends of said tamping piston, said piston ring being displaceable radially outwardly for surface contact with the inner surface of said cylinder, at least a portion of said piston ring facing toward the first end of said cylinder being free to contact the tamping material contained in said cylinder when said tamping piston is displaced axially for forcing the tamping material from the first end of said cylinder, the surface of said piston ring facing toward the second end of said cylinder having a frustoconical shape tapering inwardly toward the axis of said cylinder in the direction toward the first end of said cylinder, and said annular recess in said tamping piston having a surface facing toward the first end of said cylinder and arranged to contact the frustoconically shaped surface of said piston ring when said piston is displaced toward the second end of said tamping piston by contact between the tamping material and the surface of the piston ring facing toward the first end of said cylinder.

4. A taphole gun, as set forth in claim 3, wherein said surface of said tamping arranged to contact the frustoconically shaped surface of said piston ring having a complementary frustoconical shape.

5. A taphole gun, as set forth in claim 3, wherein said surface of said tamping piston arranged to contact the frustoconically shaped surface of said piston has a convex shape in the radial direction of said tamping piston.

6. A taphole gun, as set forth in claim 3, wherein said tamping piston has a maximum diameter which is less than the inside diameter of said cylinder so that an annular gap is formed between the circumferential periphery of said tamping piston and the inside diameter of said cylinder between said annular recess and the second end of said tamping piston.

7. A taphole gun, as set forth in claim 3, wherein said piston ring is split in the radial direction, a second recess formed in the circumferential periphery of said tamping piston at the location of the split in said piston ring, said second recess located on the side of said annular recess closer to the second end of said cylinder and opening to said annular recess, and a sliding member spanning the split in said piston ring and located in said second recess.

8. A taphole gun, as set forth in claim 7, wherein said sliding member has a complementary sloping surface arranged to seat against the frustoconically shaped surface of said piston ring.

9. A taphole gun, as set forth in claim 3, comprising a second annular recess contiguous to the annular recess containing said piston ring and located on the side of the annular recess closer to the second end of said tamping piston, a counter ring seated within said second annular recess and having a frustoconically shaped surface complementary and juxtaposed to the frustoconically shaped surface of said piston ring.

10. A taphole gun comprising an axially extending cylinder arranged to hold tamping material, said cylinder having a first end spaced axially from a second end, a tamping piston axially displaceable within said cylinder between the first and second ends for forcing tamping material from the first end of said cylinder, said tamping piston having a first end facing toward the first end of said cylinder and a second end facing toward the second end of said cylinder, a piston ring encircling the circumferential periphery of said tamping piston within said cylinder, wherein the improvement comprises that an annular recess is formed in the circumferential periphery of said tamping piston facing toward the inner surface of said cylinder, said piston ring positioned within said annular recess and spaced from the first and second ends of said tamping piston, said piston ring being displaceable radially outwardly for surface contact with the inner surface of said cylinder, at least a portion of said piston ring facing toward the first end of said cylinder being free to contact the tamping material contained in said cylinder when said tamping piston is displaced axially for forcing the tamping material from the first end of said cylinder, an annular cover disc positioned in the first end of said tamping piston on the radially outward periphery thereof and defining a closure for the side of said annular recess in said tamping piston closer to the first end of said cylinder, the radially outer surface of said cover disc being spaced inwardly from the inner surface of said cylinder to permit the tamping material to pass between the inner surface of said cylinder and the radially outer surface of said cover disc into contact with the surface of said piston ring facing toward the first end of said cylinder, and the surface of said cover disc facing toward the second end of said cylinder being spaced from the juxtaposed surface of said piston ring when said piston ring is contacted by the tamping material contained in said cylinder.

11. A taphole gun, as set forth in claim 10, wherein the inside diameter of said piston ring is greater than the diameter of the base of said annular recess so that the inside diameter surface of said piston ring is spaced from the base of said annular recess and the space therebetween is in communication with space between the surface of said cover disc facing toward the second end of said cylinder and a juxtaposed surface of said piston ring so that tamping material can flow around the radially outer edge of said cover disc between the cover disc and the piston ring into the space between the base of the annular recess and the inner diameter of the piston ring.

* * * * *